United States Patent [19]

Scrafield et al.

[11] 4,011,606

[45] Mar. 15, 1977

[54] BEDPAN LINER, KIT AND METHOD

[76] Inventors: Catherine A. Scrafield, 465 Dartmoor St., Laguna Beach, Calif. 92651; Margaret F. Leggat, 370 N. San Rafael, Pasadena, Calif. 91105

[22] Filed: Aug. 21, 1975

[21] Appl. No.: 606,440

[52] U.S. Cl. ..... 4/112; 4/142; 4/DIG. 19

[51] Int. Cl.[2] ..... A61G 9/00

[58] Field of Search ..... 4/DIG. 19, 142, 112, 4/113; 128/275; 2/198, DIG. 5

[56] References Cited

UNITED STATES PATENTS

| | | | |
|---|---|---|---|
| 2,320,845 | 1/1943 | Bolton | 4/112 |
| 2,837,746 | 6/1958 | Gundy | 2/198 |

*Primary Examiner*—Robert I. Smith
*Attorney, Agent, or Firm*—Allan R. Fowler

[57] ABSTRACT

A bedpan liner, kit and method is disclosed which allows reuse of a conventional bedpan without sterilization, and provides for clean efficient handling of bedpan wastes. The liner is a sheet of water impermeable flexible plastic material which is gathered at opposite ends and secured in the gathered condition to form an elongated hammock-like pouch with relatively rigid end portions suitable for handgripping to carry and dump the pouch. The pouch or liner has convoluted walls that can be approximately formed to the basin in a bedpan. Adhesive tabs attached to opposite ends of the pouch serve to temporarily secure the pouch to the bedpan. Tissue like paper napkins, separable from the pouch, absorb fluid wastes, reduce malodor and conceal the wastes from a person utilizing the liner, kit and method. After removing the liner from the bedpan, tension applied between the ends thereof causes the walls to contract and hold the wastes in a sling or hammock-like manner. The pouch so held by the ends is then inverted over a flushable toilet to drop both the wastes and disposable napkins when the tension between the ends is relieved, following which the pouch is contracted by applying tension between its ends, folded and inserted into a sack for separate sanitary disposal in a trash container.

10 Claims, 11 Drawing Figures

FIG. 1.
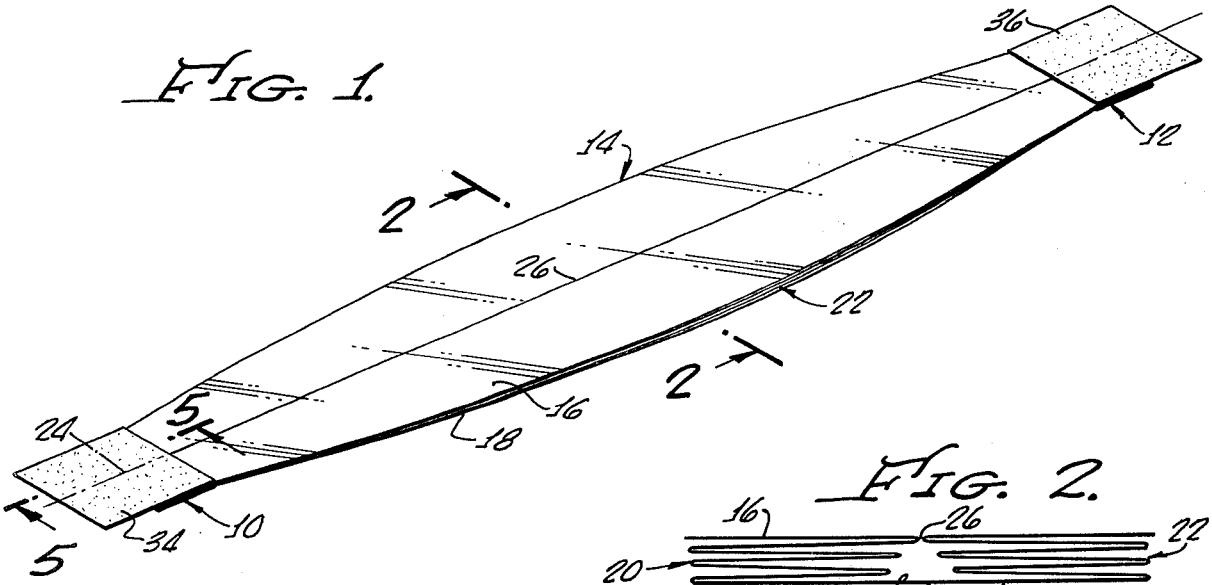
FIG. 2.
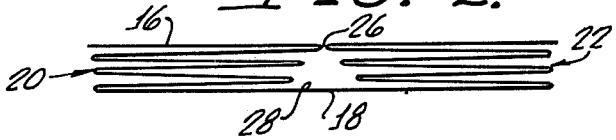
FIG. 3.
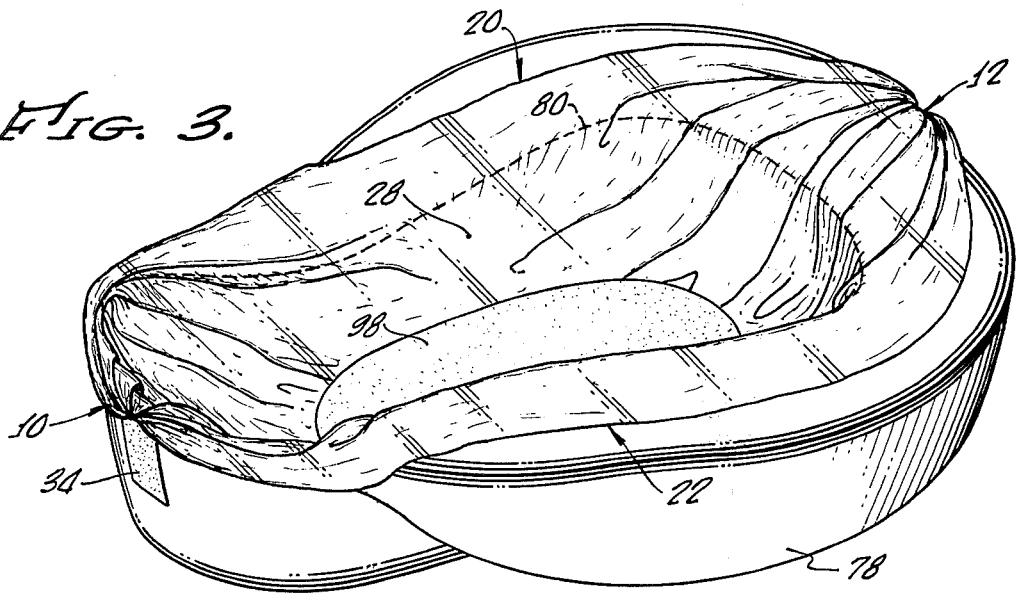
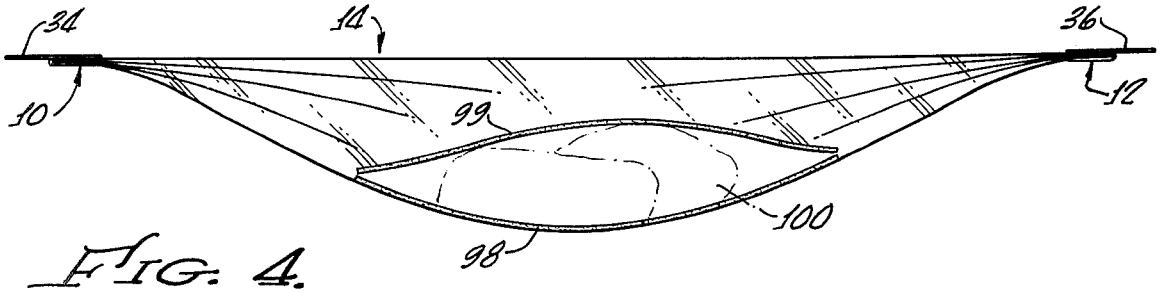
FIG. 4.

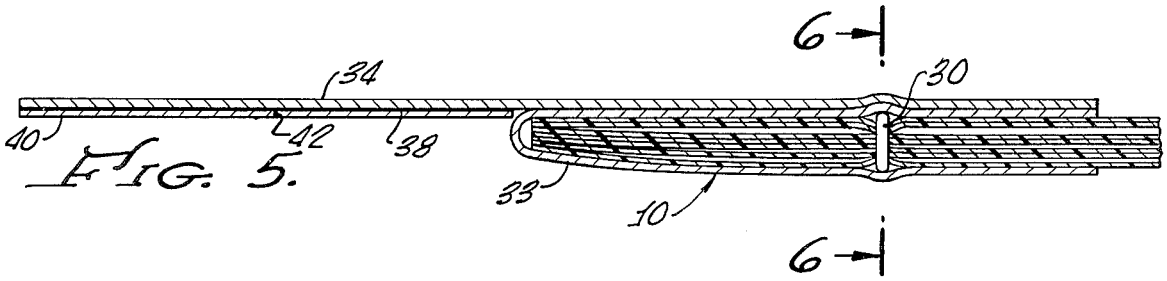
FIG. 5.
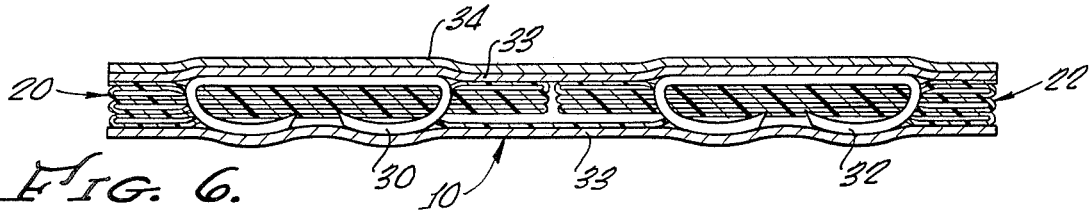
FIG. 6.
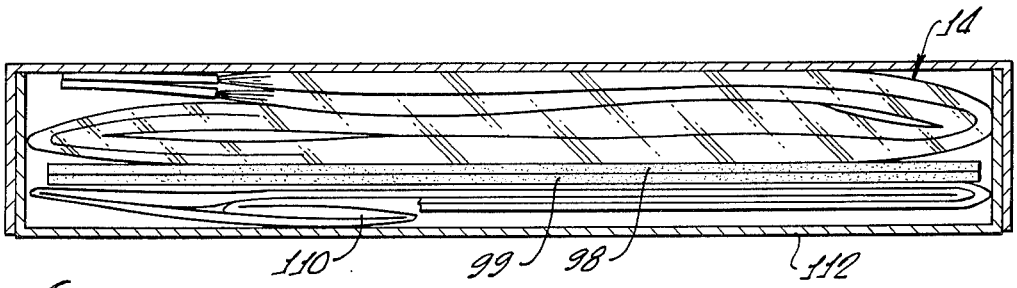
FIG. 7.
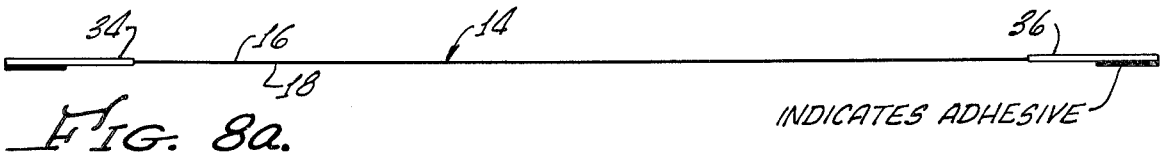
FIG. 8a.
FIG. 8b.
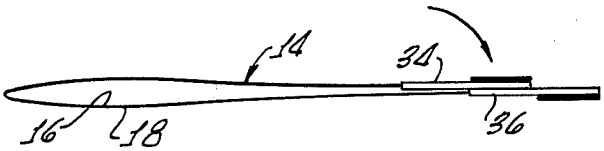
FIG. 8c.
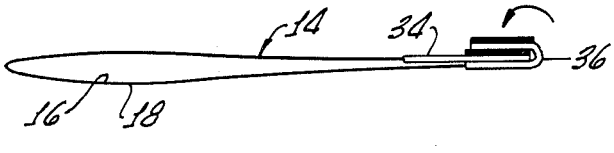
FIG. 8d.
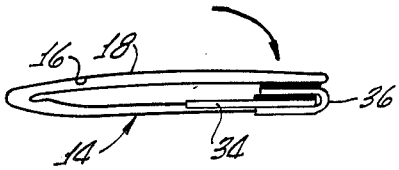

BEDPAN LINER, KIT AND METHOD

This invention relates to bedpan use. In particular it involves a disposable bedpan liner, kit and method to utilize a conventional bedpan with a reduction of malodor and visual distastefulness and without contaminating said bedpan or user with wastes.

Dirty bedpan emptying is a source of both disgust and infectious bacteria. Many bedpan liners have been designed to prevent bedpan soiling. However, a bedpan liner should not only prevent bedpan contamination, but should be of a design to facilitate ready removal and handling of wastes. The removal and handling problem is particularly critical in the nursing home or private home environments where bedpan sterilization equipment is not readily available. Furthermore, because of the usual high frequency of use, a bedpan liner kit must be of very low cost and dependable. Dependability relates to a low probability of defects which may cause rupture of the liner, and a functional design to prevent spilling during handling. Disposal of a typical liner and contents after bedpan use presents a problem since flushing the liner and wastes into a tiolet may result in the stoppage of the tiolet and connecting sewer; yet, tossing liner and prime contents into a home trash or garbage container is unsatisfactory for sanitation reasons.

We have invented a disposable bedpan liner, kit and method which not only prevents bedpan soiling and permits the reuse of bedpans without sterilization, but it also provides for efficient handling of a bedpan and wastes without the problems heretofore mentioned.

In accordance with our invention a sanitary method of utilize a conventional bedpan having a basin to receive wastes includes the steps of placing a liner of water impermeable flexible material over and into a bedpan basin, placing water disintegratable toilet tissue freely and separably on the exposed surface of said liner and inside said bedpan in a position to receive such wastes, removing the liner from the bedpan and dumping the separable tissue and wastes into a flushable toilet or the like while using the liner as a support structure, and separately disposing of said liner in a trash container or the like. Our invention also encompasses the combination of the liner with the separable toilet tissue freely disposed thereon, a kit wherein the liner and tissue are provided, and a special form of liner for facilitating our method or for independent use in the conventional manner.

Our special form of liner comprises a sheet of flexible material gathered at opposite ends to form an elongated hammock-like expandable and contractible pouch, and means securing said ends in the gathered condition. This provides a superior pouch-like support for sanitarily handling and dumping the wastes through gripping the ends of the pouch.

For use with our method, the sheet is of water impermeable material, such as thin plastic. Its pouch-like structure enables an additional step of applying tension to the pouch to at least partially encapsulate the internal surface thereon which has been exposed to wastes so that the pouch may be disposed of in a sanitary manner. Thus, in a further refinement of our method, with the contaminated surface of the pouch substantially encapsulated, the pouch may then be folded by hand while touching only the exterior surface thereon so as to further encapsulate the contaminated surface prior to disposition thereof in a trash container or the like, or so as to facilitate its insertion into a water impermeable bag prior to such disposition.

In one embodiment of the liner of our invention, the liner is in the form of an elongated hammock-like pouch having sidewalls including two stacks of accordion-like folds disposed side by side and extending longitudinally of the pouch to define a top opening therein. The stacks of folds are fastened together at each end of the pouch so as to form relatively rigid end portions of the pouch suitable for handgripping, and means including an adhesive tab is disposed at each end of the pouch for temporarily securing ends of the pouch to a bedpan. The adhesive tabs may also be used in a yet further refinement of our method to aid in holding the pouch in a folded condition.

We provide a disposable bedpan liner kit for use with our method. This kit comprises a water impermeable flexible pouch for lining a bedpan, the pouch having an inner surface for receiving the expected wastes. As a separate article in the kit we provide a pad of water disintegratable toilet tissue material adapted to be freely disposed on the inner surface so as to catch the wastes and facilitate separate sanitary disposal of the pad and wastes apart from the pouch. In addition, we include a separate water impermeable sack to contain the pouch for separate sanitary disposal thereof.

Other advantages and features of our invention will appear from the following description when considered in connection with the accompanying drawings, in which:

FIG. 1 is an overall perspective view of an exemplary embodiment of the bedpan liner of our invention, in the form of a hammock-like pouch, prior to its placement in a bedpan;

FIG. 2 is a sectional view taken along line 2—2 of FIG. 1 showing the convoluted side walls of the pouch;

FIG. 3 is an overall perspective view of the pouch expanded and approximately conforming to a conventional bedpan basin, with the adhesive end tabs securing and holding the pouch in place;

FIG. 4 is a side elevation of the pouch carrying wastes in a sling-like fashion;

FIG. 5 is a sectional view taken along line 5—5 of FIG. 1 detailing the relatively rigid ends of the liner;

FIG. 6 is a sectional view taken along line 6—6 of FIG. 5;

FIG. 7 is a view partly in section of the bedpan kit with the contents compactly folded; and, FIG. 8, comprised of FIGS. 8*a* through 8*d*, is a diagram showing the steps of folding of the pouch after use to facilitate sanitary disposal.

Referring now to the drawings, the exemplary embodiment of the bedpan liner of our invention comprises a single rectangular thin sheet of water impermeable flexible plastic material gathered at opposite ends 10, 12 to form an elongated hammock-like expandable and contractible pouch 14. The pouch has a top 16, a bottom 18, and convoluted opposite side walls 20, 22 in the form of two stacks of accordion like folds disposed side by side and extending longitudinally of the pouch. The pouch is approximately symmetric about a center line 24 running along its length, and has a top opening 26 which runs approximately along the center line on top of the pouch and is defined by the upper margins of the side walls. The pouch has an interior surface 28 for receiving the expected wastes.

As typified by the end 10 of the pouch detailed in FIGS. 5 and 6, the side by side stacks of folds are gathered as fastened together at the end 10 of the pouch by a pair metal staples 30, 32 and an adhesive tape wrapping 33, so that the end of the pouch is a relatively rigid portion suitable for handgripping. The opposite end 12 of the pouch is similarly constructed.

A pair of tabs 34, 36 of adhesive tape are stuck on the opposite ends 10, 12 of the pouch and protrude therefrom. As best been in FIG. 5, and typical for both adhesive tabs, the adhesive tab 34 is stuck to the top of the end 10 of the pouch. The protruding portion of the adhesive tab 34 has a bottom surface 38 which is coated with a pressure sensitive adhesive and covered by a removable protective covering 40 having a break 42 therein to facilitate removal thereof to expose the adhesive coated lower surface 38.

FIGS. 1 and 2 depict the pouch 14 in a contracted configuration with the folded side walls 20, 22 being collapsed and the opening 26 formed by the two side walls 20, 22 being closed. As shown the pouch is folded from a single piece of thin and flexible material, providing a seamless structure not subject to rupture. The side walls 20, 22 are comprised of accordion-like pleats or folds, with the top inside fold of the side walls defining the opening 26.

The folded side walls 20, 22 of the pouch 14 provide for expansion and contraction of the pouch. The expandability of the walls 20, 22 and the flexible nature of the pouch material allow the pouch liner to be expanded to conform to a variety of bedpan basin shapes and sizes. FIG. 3 illustrates a conventional bedpan 78, having a rounded basin 80 and the pouch 14 of the exemplary embodiment of our invention with the folded walls 20, 22 expanded and approximately conforming to the interior basin 80 of the bedpan 78. The pouch walls 20, 22 are expanded to line the bedpan basin 80 by placing a hand through the opening 26 thereby spreading the walls 20, 22 and then as the pouch liner is placed over and into the bedpan 78 and basin 80 the side walls 20, 22 are smoothed by hand motion to approximately conform to the shape of the basin thus fully exposing the interior surface 28 of the pouch. The length of the pouch, that is the distance between the ends 10, 12 of the pouch, is sufficient to allow the walls 20, 22 to conform to the bedpan basin 80 without having the ends 10, 12 of the pouch positioned in the basin portion 80 of the bedpan 78. Thus, it is apparent that only the interior surface 28 of the pouch 14 is exposed to waste matter.

The pouch 14 is temporarily secured to the bedpan 78 with the protruding portions of the end tabs 34, 36 after the pressure sensitive adhesive on the underside thereof is exposed by removal of the protective coverings 40.

After the liner pouch 14 is placed over and into the bedpan 78 and its basin 80, a pad 98 of multi-ply toilet tissue is freely and separably placed into the basin 80 onto the exposed interior surface 28 of the pouch. So disposed, the pad generally prevents direct contact between solid body wastes and the liner interior surface 28, and thus facilitates the separability of the wastes from the pouch 14 with a minimum of contamination of the interior surface 28. Additionally the pad provides an absorbent medium for liquid wastes which also promotes the separability of the wastes from the pouch. The pad 98 is constructed of multi-ply toilet tissue and has a general oval shape to allow the pad 98 to lie relatively flat in the rounded basin 80 of the bedpan 78. The exact size and shape of the pad is not critical except in allowing the pad to lie reasonably flat so that solid wastes will not generally fall between the pad 98 and the interior surface 28 of the pouch.

After body wastes 100 have been deposited on the pad 98, a second similar pad 99 of multi-ply toilet tissue is placed over the wastes 100 for sanitary reasons and to hide the wastes from view and reduce malodor. The pouch 14 is then removed by unsticking the tabs 34, 36, grasping the ends 10, 12 of the pouch and lifting the pouch out of the bedpan 78 while applying tension between the two ends. The tension causes the pouch to contract and the opening 26 to partially close as the side walls 20, 22 approach one another. The wastes 100 of the pouch provide a weight and a center of gravity below the pouch ends 10, 12, and as such the wastes can be carried in a secure sling-like fashion.

Because the pouch 14 is grasped only by its ends 10, 12 and the pouch contracts as it is lifted from the bedpan, the person handling the pouch does not touch any contaminated surfaces. Any solid wastes 100 not disposed in the center of the pouch will move toward the center as the pouch is contracted and lifted, thus reducing the chance of any spilling. Since the toilet tissue pads 98, 99 are disposed near the center of the pouch interior 28 the contracting action causes any fluids disposed outside of the pads to run into and be absorbed by them. This coalescence of the fluid wastes and the tissue pads enhances easy dumping of the wastes into a flushable toilet.

The solid wastes 100 and the tissue pad 98 are dumped from the liner 10 by inverting the pouch ends 10, 12 while relaxing the tension between them. The adsorbent pads 98, 99 coalesce the fluid wastes and help prevent such fluids from prematurely running from the pouch as it is being dumped Being covered by the tissue pads, no significant portion of the solid wastes 100 will stick to the interior surface 28 of the pouch; and, since the pads are not attached to the pouch, the pads and solid wastes can be dumped from the pouch leaving the interior surface 28 thereof relatively free from solid wastes. Of course, the ends 10, 12 and exterior surfaces of the pouch remain totally free from contamination.

Following dumping of the solid wastes 100 and pads 98, 99, the pouch is fully contracted by applying tension between the ends 10, 12 thereof, and the pouch again takes the configuration shown in FIGS. 1 and 2. This action reduces the possibility of the spread of contamination outside the pouch by encapsulating the contaminated interior surface 28 with the closing of the opening 26.

A further encapsulate the contaminated interior surface 28, and facilitate the disposal of the pouch, the pouch is folded by hand after use touching only the exterior surfaces thereof. The protruding portions of the end tabs 34, 36 with adhesive are then employed to hold the contracted liner in the folded state. This is demonstrated in FIG. 8. With ends 10, 12 held and tension applied, the pouch is contracted and the opening 26 is substantially closed. (FIG. 8*a*) As the pouch is so held the pouch is folded approximately in half with the top surface 16 doubled on itself and the bottom 18 of the pouch now becoming the exterior of the semi-folded pouch. In this fold the protruding end of the tab 34 is aligned with and placed over the non-protruding portion of the opposite tab 36 with the adhesive coating of the tab 34 facing upward. (FIG. 8*b*). Next the protruding portion of the tab 36 is folded over onto the exposed adhesive surface of the tab 34, thus sticking the tab 36 in position with the adhesive coating on its protruding portion facing upward. (FIG. 8*c*) Finally, the semifolded pouch is again folded approximately in half towards and into contact with the exposed adhesive coating of tab 36. (FIG. 8*d*) In this manner the pouch is folded to enclose the contaminated interior surface 28 and to prevent the pouch from reopening.

Further protection from the possible spread of contamination is obtained by placing the folded pouch into a separate water impermeable sack 110, and disposing of the same in a conventional trash container or the like.

The complete kit shown in FIG. 7 includes the special hammock-like pouch liner 14, absorbent toilet tissue pads 98, 99 and a water-proof disposal sack 110, all compactly stacked and held by an outer wrapping 112. The kit provides all the cooperative components for practicing our method readily at hand, for use and complete disposal as a unit.

While an exotic material utilizing a water soluable material coupled with a protective coating to prevent premature dissolving could be used as the material of construction of the special liner 14 described herein, a distinct feature of our invention is the use of cheap, simple and dependable materials and a method that eliminates problems encountered with other liners, including stoppage of toilets and sewers. These problems are eliminated by out method of separate sanitary disposal of the liner apart from the separate wastes and toilet tissue pads.

The exemplary embodiment of our invention is inexpensive and easy to manufacture using readily available materials. The use of a single piece of material for the pouch insures dependability with little possibility of leak or rupture.

We claim:

1. A disposable bedpan liner for use with a conventional bedpan having a basin to receive wastes, comprising:

a sheet of flexible material for lining a bedpan basin, said sheet being gathered at opposite ends to form an elongated hammock-like expandable and contractible pouch;

means securing said ends in the gathered condition; and, adhesive means for temporarily securing said sheet in an expanded condition to a bedpan.

2. A disposable bedpan liner for use with a conventional bedpan having a basin to receive wastes, comprising:

a sheet of flexible material for lining a bedpan basin, said sheet being gathered at opposite ends to form an elongated hammock-like expandable and contractible pouch;

means securing said ends in the gathered condition; and, an adhesive coated tab disposed at each of said gathered ends of said sheet for temporarily securing the sheet in an expanded condition to a bedpan.

3. For use with a conventional bedpan having a basin to receive wastes, the combination which comprises:

a sheet of water insoluable flexible plastic material for lining said basin, said sheet being gathered at opposite ends to form an elongated hammock-like expandable and contractible pouch having an interior surface for receiving said wastes;

means securing said sheet ends in the gathered condition; and, water disintegratable toilet tissue material freely disposed on and separable from said interior surface in a position to catch said wastes so as to facilitate separate sanitary disposal of said sheet apart from said tissue material and wastes.

4. The combination as claimed in claim 3 wherein the tissue material includes multiple layers formed into a pad adapted to conform to the bedpan basin.

5. For use with a conventional bedpan having a basin to receive wastes, a bedpan liner comprising:

an elongated hammock-like pouch of water insoluble flexible plastic material for lining a bedpan basin; the pouch having relatively rigid opposite ends, and flexible longitudinally folded walls gathered at said ends, said walls defining an upper longitudinal opening extending between the ends of the pouch, and said walls defining an interior surface of said pouch for receiving said wastes, said interior surface being encapsulated within the pouch with the walls in a longitudinally tensioned condition; whereby the ends may be used as handgrips for sanitary disposal of waste contents from the pouch and to apply tension to narrow said opening to encapsulate said interior surface for separate sanitary disposal of said pouch.

6. The combination as claimed in claim 5 wherein said ends include a covering of adhesive tape and an adhesive coated tab for temporarily securing the pouch in an expanded condition to a bedpan.

7. A disposable bedpan liner for use with a conventional bedpan having a basin to receive wastes, comprising:

a water impermeable expandable and collapsible hammock-like pouch of flexible sheet material, said pouch being elongated and having opposite ends, a top, bottom and opposite side walls;

the pouch being approximately symmetric about a center line running the length of the pouch and having a top opening which runs approximately along the center line on top of the pouch and is defined by the side walls of the pouch;

said side walls including two stacks of accordion like folds disposed side by side and extending longitudinally of the pouch;

means fastening the side by side stacks of folds together at each end of the pouch so as to form relatively rigid end portions of the pouch suitable for handgripping; and, means including an adhesive coated tab disposed at each end of said pouch for temporarily securing the pouch in an expanded condition to a bedpan.

8. A disposable bedpan liner kit for use with a conventional bedpan which includes a basin to receive wastes, said liner kit comprising:

a water impermeable expandable and collapsible hammock-like pouch of flexible sheet material gathered at opposite ends for lining a bedpan basin, said pouch having adhesive means for temporarily securing the pouch in an expanded condition to a bedpan;

a separate pad of water disintegratable toilet tissue material adapted to be freely disposed on said interior surface so as to catch said wastes and facilitate separate sanitary disposal of said pad and wastes apart from said pouch; and, a separate water impermeable sack to contain said pouch for separate sanitary disposal thereof.

9. A sanitary method to utilize a conventional bedpan having a basin to receive wastes, comprising the steps of: placing an expandable and contractible hammock-like pouch of water impermeable flexible material gathered at opposite ends over and into the basin of a bedpan, placing water disintegratable toilet tissue freely and separably on the surface of said pouch inside said bedpan in a position to receive the wastes, removing the pouch from the bedpan and dumping the separable toilet tissue and wastes into a flushable toilet or the like while using the pouch as a support structure, applying tension to said pouch to at least partially encapsulate the surface thereon exposed to said wastes, and separately disposing of said pouch.

10. A sanitary method to utilize a conventional bedpan having a basin to receive wastes, comprising the steps of: placing an expandible and contractible hammock-like pouch of water impermeable flexible material gathered at opposite ends over and into the basin of a bedpan and securing the same thereon with adhesive coated tabs, placing water disintegratable toilet tissue freely and separably on the surface of said pouch inside said bedpan in a position to receive the wastes, removing the pouch from the bedpan and dumping the separable toilet tissue and wastes into a flushable toilet or the like while using the pouch as a support structure, applying tension to said pouch to at least partially encapsulate the surface thereon exposed to said wastes, folding said pouch, using said adhesive coated tabs to secure the pouch in the folded condition, and separately disposing of said folding pouch in a trash container or the like.

* * * * *